United States Patent [19]

Lephardt

[11] Patent Number: 4,553,556

[45] Date of Patent: Nov. 19, 1985

[54] CIGARETTE HAVING A CORRUGATED WRAPPER

[75] Inventor: John O. Lephardt, Richmond, Va.

[73] Assignee: Philip Morris Incorporated, New York, N.Y.

[21] Appl. No.: 592,063

[22] Filed: Mar. 22, 1984

[51] Int. Cl.[4] ..... A24D 1/02

[52] U.S. Cl. ..... 131/336; 131/331; 131/361; 131/365

[58] Field of Search ..... 131/336, 331, 339, 340, 131/341, 360, 365, 349, 361

[56] References Cited

U.S. PATENT DOCUMENTS

| | | | |
|---|---|---|---|
| 1,338,529 | 4/1920 | Richter | 131/331 |
| 1,718,122 | 6/1929 | Shon | 131/336 |
| 2,035,398 | 3/1936 | Muller | 131/361 |
| 2,098,619 | 11/1937 | Finnell | 131/349 |
| 2,462,446 | 2/1949 | Wellborn | 131/361 |
| 2,667,170 | 1/1954 | Lebert | 131/331 |
| 2,936,764 | 5/1960 | van Tuyl | 131/341 |
| 2,981,261 | 4/1961 | Rupert | 131/336 |
| 3,490,461 | 1/1970 | Osmalov et al. | 131/336 |
| 3,516,417 | 6/1970 | Moses | 131/271 |
| 3,596,663 | 8/1971 | Schultz | 131/336 |
| 3,773,053 | 11/1973 | Stephens, Jr. | 131/339 |
| 3,910,287 | 10/1975 | Walton | 131/339 |
| 4,109,665 | 8/1978 | Godfrey et al. | 131/358 |

FOREIGN PATENT DOCUMENTS

| | | | |
|---|---|---|---|
| 240650 | 9/1962 | Australia | 131/331 |
| 864247 | 3/1961 | United Kingdom | 131/336 |
| 868058 | 5/1961 | United Kingdom | 131/331 |

*Primary Examiner*—Vincent Millin
*Assistant Examiner*—H. Macey

[57] ABSTRACT

A cigarette is provided which includes a corrugated wrapper. The corrugated wrapper is constructed such that the outer surface and the inner surface are separated by a distance which is less than the minimum transverse dimension of the tobacco rod. The corrugated wrapper, when incorporated in a cigarette, provides a cigarette in which firmness and rigidity can be made independent of the density of the smoking material.

4 Claims, 9 Drawing Figures

CIGARETTE HAVING A CORRUGATED WRAPPER

FIELD OF THE INVENTION

This invention relates to improved smoking articles and more particularly, to a cigarette or the like having a corrugated wrapper.

BACKGROUND OF THE INVENTION

In manufacturing mass produced cigarettes, it is important to maintain various parameters constant from cigarette to cigarette so that one cigarette is virtually identical to the next. One of the characteristics closely controlled in cigarettes is the density of the tobacco rod. Density of the tobacco rod is important for several reasons, one of which is that it affects the smoking characteristics of the cigarette. Another reason is that a cigarette which is not dense enough will tend to deform in the hand of the smoker.

The density of the tobacco in a cigarette has been associated, in general, with the firmness chartacteristics of the cigarette because the conventional cigarette wrapper has little structural strength and serves mainly to contain the rod of tobacco. Thus, the cigarette rod owes its structural strength almost entirely to the density of the tobacco in the rod. A conventional cigarette has a rod of compacted tobacco shreds surrounded by a very thin paper wrapper. Its rigidity and firmness are largely dependent on density of the rod. To use a less dense rod is not practical because the cut tobacco filler of the cigarette would not stay together, and to make the paper wrapper thicker and stronger still would not keep the tobacco from falling out if it were more loosely packaged.

Accordingly, there exists in the art a need for a cigarette in which the structural rigidity of the cigarette is relatively independent of the density of the tobacco.

SUMMARY OF THE INVENTION

A cigarette is provided which includes a corrugated wrapper. The corrugated wrapper is constructed such that the outer surface and the inner surface are separated by a distance which is less than the minimum transverse (cross-sectional) dimension of the tobacco rod. The corrugated wrapper, when incorporated in a cigarette, provides a cigarette in which firmness and rigidity can be made independent of the density of the smoking material. The corrugated wrappers can be made of low weight conventional cigarette paper or similar sheet materials. The corrugated wrapper may be a combination of thin, flexible inner and outer layers of sheet material with a layer of corrugated sheet material therebetween. In another embodiment of the present invention, the tobacco rod can be replaced by an unwrapped extruded rod of smoking material, or any other desired smoking material.

DESCRIPTION OF THE PREFERRED EMBODIMENTS

Figure 1:
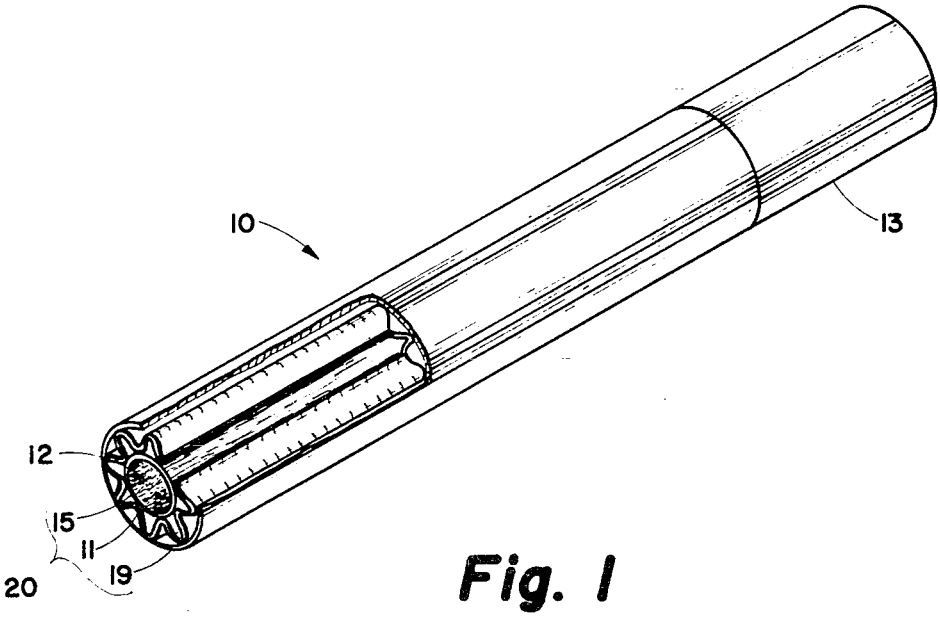
FIG. 1 is a perspective view, partially cut away, of a first embodiment of a cigarette of the present invention.

Referring now to the drawings and more particularly to FIG. 1, there is illustrated an embodiment of the invention in the form of a cigarette designated generally by the numeral 10. Cigarette 10 consists of a column of cut tobacco filler 12 enclosed by a composite cigarette wrapper 20. A filter 13 is attached in a conventional manner.

Wrapper 20 includes a layer of corrugated sheet material 11, sandwiched between two layers of conventional cigarette paper 19 and 15. The inner layer 15 serves to prevent shreds of tobacco in rod 12 from escaping into the open spaces formed by the corrugations. The outer layer 19 is desirable for the sake of appearance, and, in the embodiment shown in FIG. 1, it also serves to support the corrugated structure. The wrapper can have a thickness of up to one-half the diameter of the cigarette. Typically, for a cigarette having a circumference of from 22 to about 25 mm, the thickness will be between about 1 and about 2.5 mm.

The number of corrugations or ridges should be kept to a minimum consistent with achieving the structural rigidity desired, in order to reduce the amount of material used in forming the wrapper. While the minimum number of corrugations may be dependent on the particular application, it is particularly preferred that the corrugations be spaced, peak to valley, at least as close together as their height, so that a tangent to their sloping intermediate portions, assuming a regular sinusoidal wave form, makes an angle at least as steep as about 45° relative to a radial reference line, in order to achieve the desired structural rigidity. The cigarettes including the corrugated wrapper should have a firmness value within the range of from about 0.5 to about 7 $mm \times 10^{-1}$.

A number of different materials are suitable for use as inner layer 15, corrugated layer 11, and outer layer 19. For example, any of various standard cigarette papers may be used for any one or more of the three components. Alternatively, materials such as reconstituted tobacco, which is made by a paper-making-type process may be used for any one or more of the three components. One or more of the components could be made from a non-combustible material, such as materials based on silicon.

Other characteristics which may be varied are burn rate and the porosity of the wrapper components. Typically, the porosity of cigarette paper employed in the manufacture of the various layers will be within the range of from about 8 to about 30 sec. For example, outer layer 19 could be made from low-porosity and low burn rate paper, and corrugated layer 11 and inner layer 15 could be made from more porous and faster burning material. This would result in the coal of cigarette 10 having a tendency to burn within outer layer 19 since outer layer 19 would be consumed more slowly than tobacco rod 12, inner layer 15, and corrugated layer 11. This would tend to reduce the flow of air radially into the rod through the corrugations, and help to maintain the coal intact.

Figure 2:
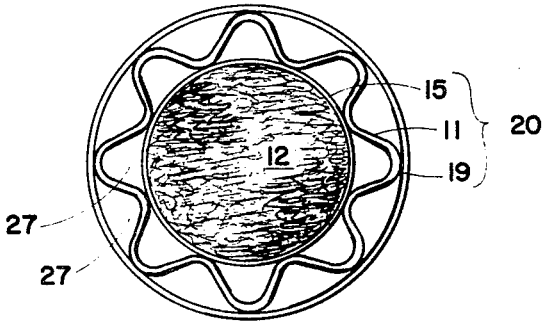
FIG. 2 is a cross section perpendicular to the longitudinal axis of the cigarette shown in FIG. 1.

FIG. 2 shows more clearly the reduced diameter of the tobacco column 12 when using a corrugated wrapper 20. It is easily seen that cigarette 10 may have a lower overall weight due to the void spaces 27 formed between inner layer 15 and corrugated layer 11, and between outer layer 19 and corrugated layer 11.

Figure 3:
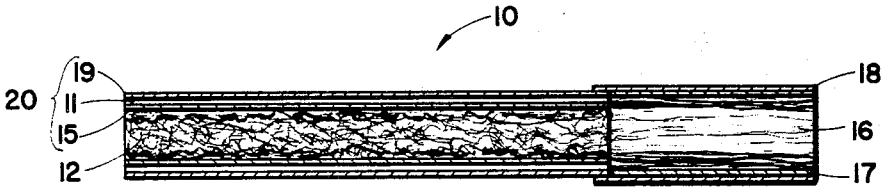
FIG. 3 is a longitudinal cross section of the cigarette shown in FIG. 1.

FIG. 3 shows how filter 13, which includes cellulose acetate filter 16 and plug wrap 17, may be attached to corrugated wrapper 20 using tipping paper 18, as is well known in the art.

Figure 4:
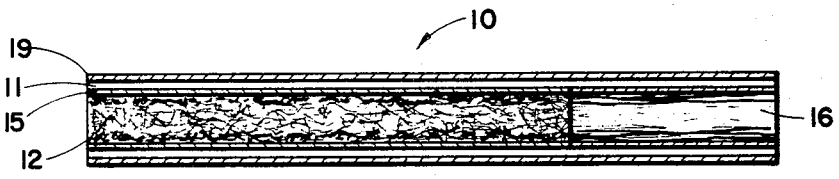
FIG. 4 is a longitudinal cross section of a second embodiment of a cigarette of the present invention.

In the embodiment shown in FIG. 4, a reduced diameter, non-wrapped acetate (NWA) filter plug 21 is joined to tobacco column 12 by corrugated wrapper 20.

Figure 5:
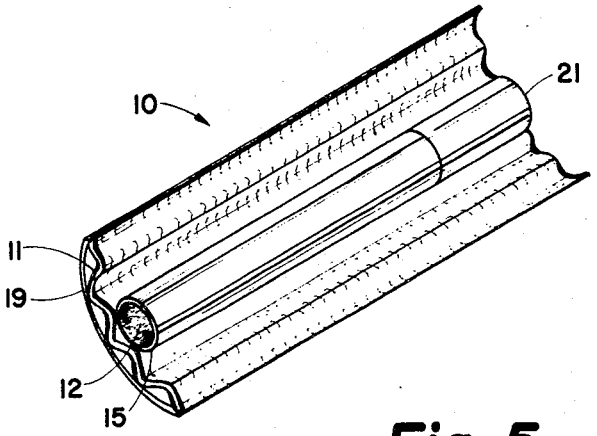
FIG. 5 is a perspective view of the embodiment shown in FIG. 4, partially disassembled.

FIG. 5 illustrates the assembly of an embodiment of the present invention similar to the embodiment shown in FIG. 4. Tobacco column 12 has been enclosed in inner layer 15 by a conventional cigarette making process to form a tobacco rod. Filter 21 is a non-wrapped acetate plug, and is approximately the same diameter as the tobacco rod. Typically, the circumference of the tobacco rod will be from about 22 to about 25 mm. Outer layer 19 and corrugated layer 11, previously joined to each other, are then wrapped around inner layer 15 and filter 21 during a tipping operation, thus joining filter 21 and layer 15 together to form a completed cigarette as shown in FIGS. 4 and 5. This embodiment could be made with relatively minor alterations to conventional cigarette making machines and tipping machines.

Figure 6:
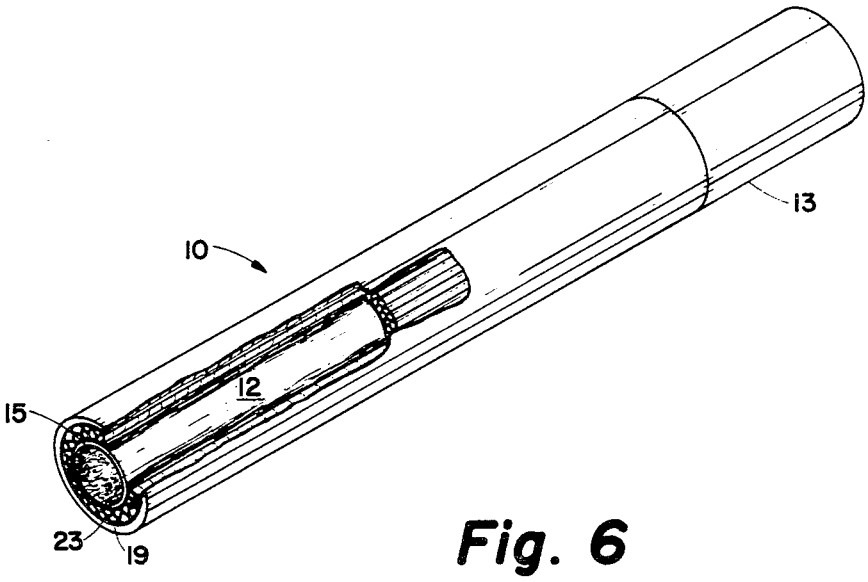
FIG. 6 is a perspective view partially cut away of a third embodiment of a cigarette of the present invention.
Figure 7:
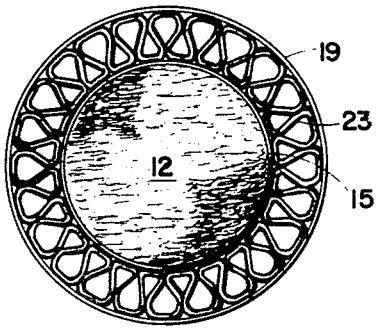
FIG. 7 is a cross section perpendicular to the longitudinal axis of the embodiment shown in FIG. 6.

FIG. 6 shows an embodiment of the invention in which corrugated wrapper 23 has a much greater density of corrugations such that the corrugations actually bend back upon themselves and form loops, each of which touches the preceeding and following loop of the corrugation near the outer layer 19 and again near the inner layer 15.

Figure 8:
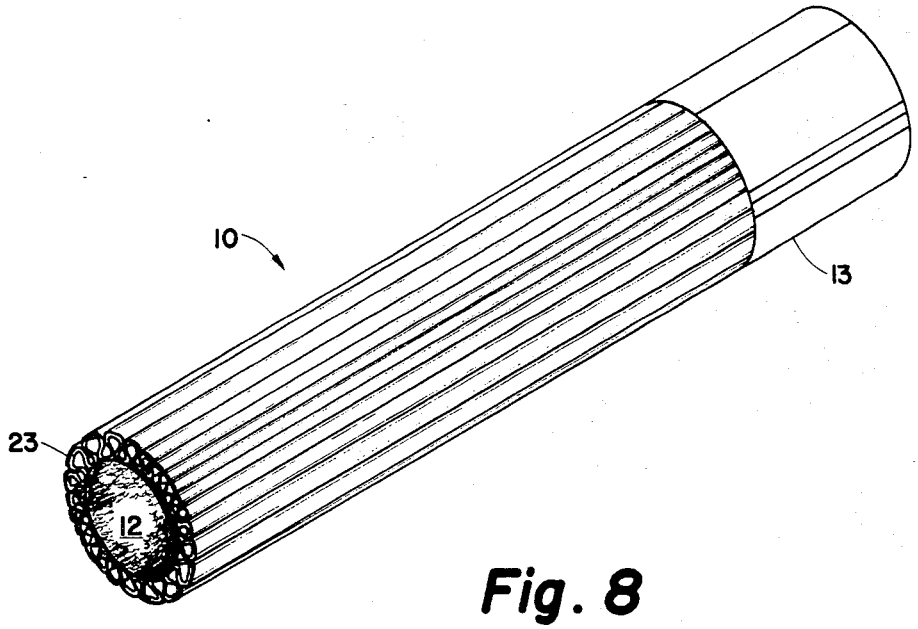
FIG. 8 is a view of a fourth embodiment of a cigarette of the present invention.

FIG. 8 shows yet another embodiment of a corrugated wrapper 23 such as shown in FIG. 6 in which the corrugations also bend back to form loops, and each of the loops touches the preceeding and following ones near the outer and inner circumference of the corrugated wrapper. In this embodiment, however, inner layer 15 and outer layer 19 are omitted and the corrugations are glued or otherwise attached at least at those points where they contact each other near the outer circumference of the wrapper. Such a corrugated wrapper can be made sufficiently flexible for use with conventional cigarette making machines. Since the corrugations are pressed tightly together near the tobacco column 12, little, if any, tobacco escapes into the spaces between the corrugations. Omitting the outer layer gives the tobacco rod a distinctive appearance which may appeal to certain market segments.

Figure 9:
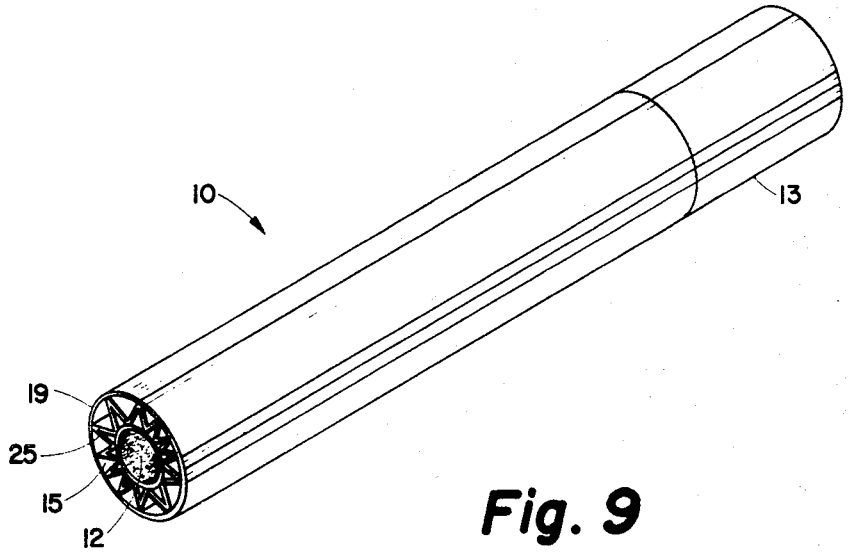
FIG. 9 is a perspective view of a fifth embodiment of a cigarette of the present invention.

FIG. 9 shows an embodiment of the present invention in which the corrugations 25 are substantially triangular in shape. This embodiment allows for the use of less glue in the formation of the rod, which is desirable because excessive use of glue may affect the taste of the finished product. Any suitable adhesive may be used in the fabrication of the cigarettes described above, as is well known in the art.

Materials suitable for use in tobacco column 12 are not limited to cut tobacco filler. Other materials such as expanded tobacco or suitable tobacco-like materials may be used. Depending on the thickness of the corrugated layer, a tobacco column having a length of from about 50 to about 100 mm included in a cigarette having a circumference of from about 22 to about 25 mm, can contain from about 200 to about 1000 mg of tobacco.

The axially extending channels defined by the corrugations in the various embodiments of the present invention which are shown in the figures may be either open or closed and, if closed, may be closed at the mouth end, filter end or both of the cigarette depending on the particular application. If the channels are closed, it may be desirable to perforate the wrapper adjacent the mouth end when dilution is desired. If flavoring is to be added to the corrugated wrapper, then the channels are preferably open so that smoke and air may be drawn along the channels into the smoker's mouth. The corrugated wrapper 20 shown in the various embodiments provides an ideal vehicle for incorporation of flavors into a cigarette wrapper. The flavoring material may be applied to the void spaces in the corrugations or may be encapsulated in the material used to make the composite wrapper.

In other embodiments, all of the channels can be closed, or only some of the channels can be closed. For example, the outer channels could be closed and the inner channels left open or the inner channels could be closed and the outer channels left open. Closing either the inner channels or the outer channels while leaving the others open can be accomplished during manufacture by depositing an excess of adhesive where that particular set of channels touches the inner layer of sheet material or the outer layer of sheet material. Alternatively, the channels may be sealed prior to manufacture of the cigarette.

I claim:

1. A filter cigarette, comprising an elongated rod of smoking material, a filter attached to the mouth end of the rod, and a corrugated wrapper enclosing the rod of smoking material along substantially the full length of the rod, the corrugated wrapper comprising:

a. an inner layer of sheet material peripherally enclosing the rod;

b. an outer layer of sheet material peripherally enclosing the inner layer, spaced outwardly from the inner layer and defining a gap therebetween, the gap being thinner than the minimum transverse dimension of the rod, said gap and layers of sheet material comprising from at least about 1 mm to about 2.5 mm of the diametrical thickness of the rod and the wrapper; and c. a layer of corrugated sheet material peripherally enclosing the inner layer, forming axially extending channels, the channels being closed substantially to prevent axial flow of smoke or air through the channels to the mouth end of the cigarette and disposed within the gap between the inner and outer layers, the corrugated sheet material providing a rigidity and firmness to the cigarette which is relatively independent of rod density.

2. The cigarette of claim 1 wherein the corrugations comprise consecutive loops arranged so that each loop contacts both the preceding loop and the succeeding loop adjacent both the radially outer and inner surfaces of the corrugated sheet material.

3. A cigarette, comprising an elongated rod of smoking material, and a corrugated wrapper peripherally enclosing the rod along substantially the full length of the rod, the wrapper comprising corrugations from about 1 mm to about 2.5 mm thick having consecutive loops pressed tightly together such that each loop contacts both the preceding loop and the succeeding loop adjacent both the radially outer and inner circumferences of the wrapper.

4. The cigarette of claim 3 wherein each consecutive loop is attached to the preceding loop and the succeeding loop at the radially outer points of contact between the loops.

* * * * *